US007802519B2

(12) United States Patent
Koch

(10) Patent No.: US 7,802,519 B2
(45) Date of Patent: Sep. 28, 2010

(54) METHOD AND APPARATUS FOR PRODUCTION OF AN INFRARED AREA EMITTER

(75) Inventor: Ernst-Christian Koch, Kaiserslautern (DE)

(73) Assignee: Diehl BGT Defence GmbH & Co. KG, Überlingen (DE)

( * ) Notice: Subject to any disclaimer, the term of this patent is extended or adjusted under 35 U.S.C. 154(b) by 29 days.

(21) Appl. No.: 12/412,890

(22) Filed: Mar. 27, 2009

(65) Prior Publication Data

US 2009/0184266 A1 Jul. 23, 2009

Related U.S. Application Data

(62) Division of application No. 11/087,042, filed on Mar. 22, 2005, now abandoned.

(30) Foreign Application Priority Data

Apr. 19, 2004 (DE) ..... 10 2004 018 862

(51) Int. Cl.
*F42B 12/48* (2006.01)

(52) U.S. Cl. ..... 102/334; 89/1.11

(58) Field of Classification Search ..... 89/1.11; 102/334, 363, 364, 365, 367
See application file for complete search history.

(56) References Cited

U.S. PATENT DOCUMENTS

| | | | | |
|---|---|---|---|---|
| 3,150,848 A | | 9/1964 | Lager et al. | |
| 3,730,093 A | * | 5/1973 | Cummings | 102/363 |
| 4,015,355 A | * | 4/1977 | Schiessl et al. | 42/105 |
| 4,474,715 A | * | 10/1984 | Weber et al. | 264/3.1 |
| 4,534,810 A | * | 8/1985 | Knapp | 149/19.6 |
| 4,697,521 A | * | 10/1987 | Espagnacq et al. | 102/334 |
| 5,343,794 A | | 9/1994 | Andreotti et al. | |
| 5,389,308 A | * | 2/1995 | Busel et al. | 252/587 |
| H1522 H | | 4/1996 | Campillo et al. | |
| 5,635,666 A | * | 6/1997 | Bannasch et al. | 102/334 |
| 5,834,680 A | * | 11/1998 | Nielson et al. | 102/336 |
| 6,427,599 B1 | * | 8/2002 | Posson et al. | 102/336 |
| 6,581,520 B1 | | 6/2003 | Koch et al. | |

FOREIGN PATENT DOCUMENTS

| | | |
|---|---|---|
| DE | 3515166 C2 | 10/1986 |
| WO | WO9505572 | 2/1995 |
| WO | WO9857847 | 12/1998 |

* cited by examiner

*Primary Examiner*—Troy Chambers
(74) *Attorney, Agent, or Firm*—Scully, Scott, Murphy & Presser, P.C.

(57) ABSTRACT

A method for production of an infrared area emitter which can be used for defense against guided missiles with infrared homing heads, for example for ships. According to the invention, an aerosol cloud which is emissive in the infrared range is produced by the reaction of a first primary aerosol composed of an aqueous solution of an electron acceptor with a second primary aerosol composed of an aqueous solution of an electron donor in order to produce the infrared area emitter. The use of primary aerosols such as these leads to emission at 3-5 and 8-14 μm, and does not produce any visual signature either.

19 Claims, 1 Drawing Sheet

METHOD AND APPARATUS FOR PRODUCTION OF AN INFRARED AREA EMITTER

RELATED APPLICATION

This application is a divisional of U.S. patent application Ser. No. 11/087,042, filed Mar. 22, 2005.

FIELD OF THE INVENTION

The present invention relates to a method and an apparatus for production of an infrared area emitter.

BACKGROUND OF THE INVENTION

Autonomously guided missiles such as air to air and surface to air guided missiles are frequently used in the military field for attacking targets such as jet aircraft, helicopters, armoured vehicles and ships, and are normally equipped with infrared homing heads for direction-finding and tracking of the target. In order to provide defense against such guided missiles with infrared homing heads, aircraft use a wide range of different electronic and pyrotechnic countermeasures, such as infrared jammers and infrared decoys, which imitate the infrared signature of the target in order to spoof the approaching guided missiles. These countermeasures are matched, in particular, to the characteristics of aircraft, in particular specifically to their engines.

Specific countermeasures for protection of land-based and surface-vessel platforms, such as tanks and ships, against attacking guided missiles with infrared homing heads must likewise be matched to the characteristic features of the target. By way of example, ships are comparatively cool targets ($T_{max}$=200° C.), so their maximum emission occurs in the spectral range between 8 and 14 μm while, in contrast, jet aircraft in particular have maximum emission levels in the range from 2 to 5 μm. A further difference from aircraft is the low relative speed of ships and the large surface area, the large surface area emitting infrared radiation (200 to 2000 $m^2$ for ships in comparison to 20 to 50 $m^2$ for aircraft). Furthermore, the surface area which emits the infrared radiation is considerably contoured and also has short-wave emission maxima (so-called hot spots) which may be caused by particularly hot parts such as the funnel and the catapult launcher.

FIG. 1 shows the beam strength distribution for a grey emitter 1 and a black-body emitter 2 for an assumed body temperature of 473° K. The abscissa shows the wavelength in μm. The ordinate shows the beam strength in mW $cm^{-2}$ $\mu m^{-1}$. Owing to the illustrated characteristic for the selective emitter, guided weapons with imaging two-colour infrared homing heads in the ranges 2 to 5 μm and 8 to 14 μm are preferably used for attacking ships.

DISCUSSION OF THE PRIOR ART

Various infrared decoy targets have already been developed in the prior art in order to protect ships against guided missiles.

Thus, for example, U.S. Pat. No. 5,343,794 discloses a simple floating flare, which is operated with polydimethyl siloxane, in order to achieve good spectral matching with the signature of ships. Despite the good spectral matching, this floating flare does not have the necessary area extent and, in some cases, also lacks the structuring of the infrared source.

These problems can be overcome by the use of aerodynamic small disc decoys. These essentially comprise combustible sheets which are coated with red phosphorus and a thickener, as are described by way of example in DE 35 15 166 C2. The disadvantage of these known infrared decoys is once again the lack of spectral matching, since these small disc decoys based on red phosphorus emit particularly strongly in the short-wave infrared range. WO-A-95/05572 therefore describes how the spectral intensity distribution of burning small disc decoys based on red phosphorus can advantageously be changed by the addition of additives which regulate the combustion and are based on silicates.

Despite intensive efforts to adapt the spectral intensity distribution of pyrotechnic decoys, modern infrared homing heads can also reject these decoys. This is based on the fact that pyrotechnic emitters, irrespective of whether they are conventional emitters or else spectrally adapted emitters (see WO-A-95/05572), always still have excessive emission strengths in the short-wave infrared range. These decoys are therefore identified by the infrared homing head as a target which has already been hit, and are therefore excluded from the rest of the attack. In consequence, the actual, cooler target is detected again, and is attacked. A further problem associated with pyrotechnic infrared decoys is the inherent fire risk for ships in the area close to deployed decoys based, for example, on red phosphorus.

Finally, for the protection of potential target objects in the marine environment, WO-A-98/57847 proposes a method for production of water clouds which, by the addition of additives which are not specified in any more detail, can also be used for absorption in spectral ranges which are not specified in any more detail. However, this conventional method does not solve the problem of how to produce infrared-emissive decoys for protection, for example, of ships. Furthermore, the extent of the water cloud described in WO-A-98/57847 would have to reach such extents that the complete infrared signature of the ship is reduced to a specific level below the contrast threshold.

SUMMARY OF THE INVENTION

The present invention is thus based on the object of providing a method and an apparatus for production of an infrared area emitter by means of which the problems described above can be solved. One particular aim is for the infrared area emitter that is produced to better imitate the infrared signature of the target, and also to have an extent whose size corresponds to that of the target.

This object is achieved by a method for the production of an infrared area emitter wherein there is produced an aerosol cloud which is emissive in the infrared range. Also provided is an apparatus for implementing the method wherein the apparatus includes a first container with a first solution therein and a second container with a second solution contained therein, wherein a first primary aerosol of the first solution and a second primary aerosol of the second solution react with each other in order to produce an aerosol cloud which is emissive in the infrared range.

DETAILED DESCRIPTION OF THE INVENTION

According to the invention, an infrared area emitter in the form of a spectrally matched decoy for defense against guided missiles with infrared homing heads is provided by producing an aerosol cloud which is emissive in the infrared range. This aerosol cloud which is emissive in the infrared range is produced by the combination and reaction of a first and a second primary aerosol, which are preferably atomized with one another under pressure.

The first primary aerosol is in this case produced from a solution of an electron acceptor, while the second primary aerosol is preferably produced from a solution of an electron donor. Suitable electron acceptors for the first primary aerosol are selected from the group of acids containing oxygen, and are preferably selected from phosphoric acid and sulphuric acid; suitable electron donors for the second primary aerosol are selected from the group of alkaline metal hydroxides, alkaline metal carbonates, alkaline metal hydrogen carbonates and mixtures of them, such as lithium hydroxide, lithium carbonate, lithium hydrogen carbonate, sodium hydroxide, sodium carbonate, sodium hydrogen carbonate, potassium hydroxide, potassium carbonate, potassium hydrogen carbonate, rubidium hydroxide, rubidium carbonate, rubidium hydrogen carbonate, cesium hydroxide, cesium carbonate and cesium hydrogen carbonate. When the two aqueous solutions are combined in the form of an aerosol, a strong exothermic reaction occurs in accordance with the following equation:

$$H_3PO_{4\,ae}+MOB_{ae}\rightarrow M_2PO_{4\,ae}+H_2O_{ae}+Q$$

where M=Li, Na, K, Rb, Cs

The reaction heat Q that is produced is preferably emitted in the long-wave infrared range (8 to 14 μm) owing to the selective emission characteristics of the reaction products (for example sulphates, phosphates, hydrogen phosphates and dihydrogen phosphates). In particular, the use of phosphoric acid as an electron acceptor for the first primary aerosol leads to the formation of alkaline metal dihydrogen phosphates, hydrogen phosphates and orthophosphates which have strong emission bands in the atmospheric transmission windows at 3 to 5 μm and 8 to 14 μm. In the marine environment, with typically high air humidity concentrations, the formation of hydrates of the corresponding salts can also be expected, which also results in approximately an additional 300 kJ of thermal energy per mole of bonded water.

The use of the primary aerosols according to the invention advantageously does not produce any visual signature thus preventing visual identification of the decoy, particularly at night, since clouds and mist may be regarded as being typical in a marine environment.

Furthermore, the stoichiometric use of the so-called primary aerosols to produce the infrared area emitter results only in aerosol droplets containing salt. These are neither toxic, dangerously combustible nor corrosive, thus representing a further advantage over the conventional infrared area decoys.

Figure 1:
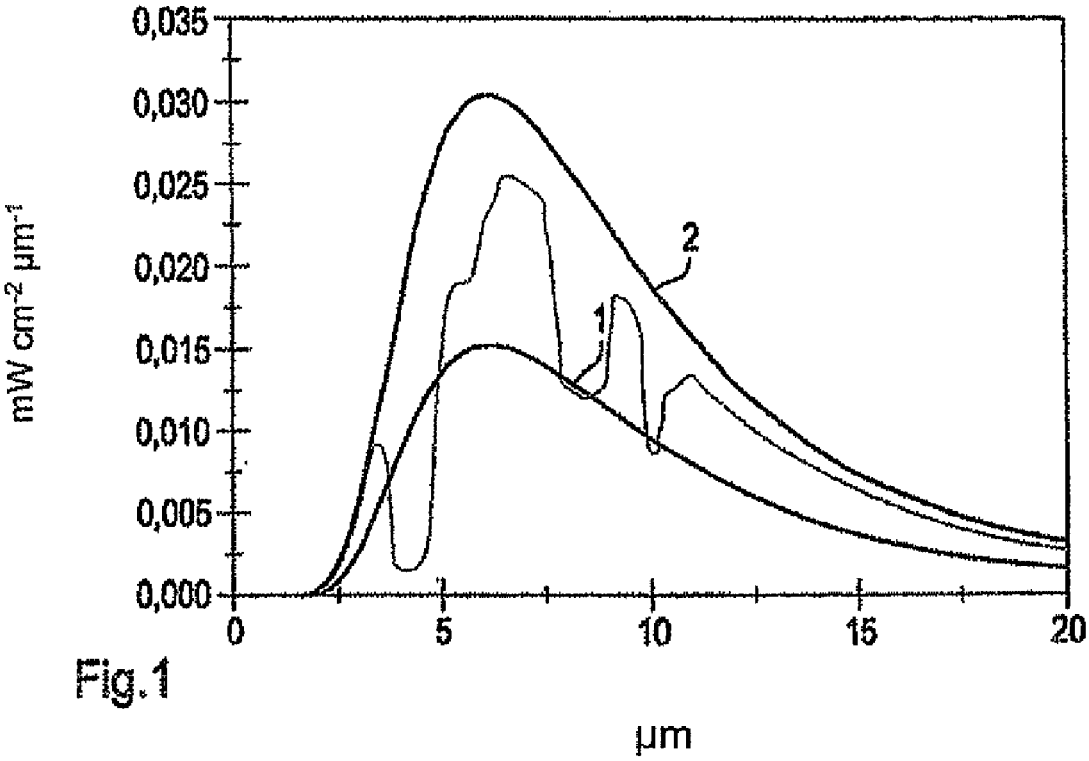
FIG. 1 is a graph showing the beam strength distribution for a grey emitter 1 and a black-body emitter 2 for an assumed body temperature of 473° K.
Figure 2:
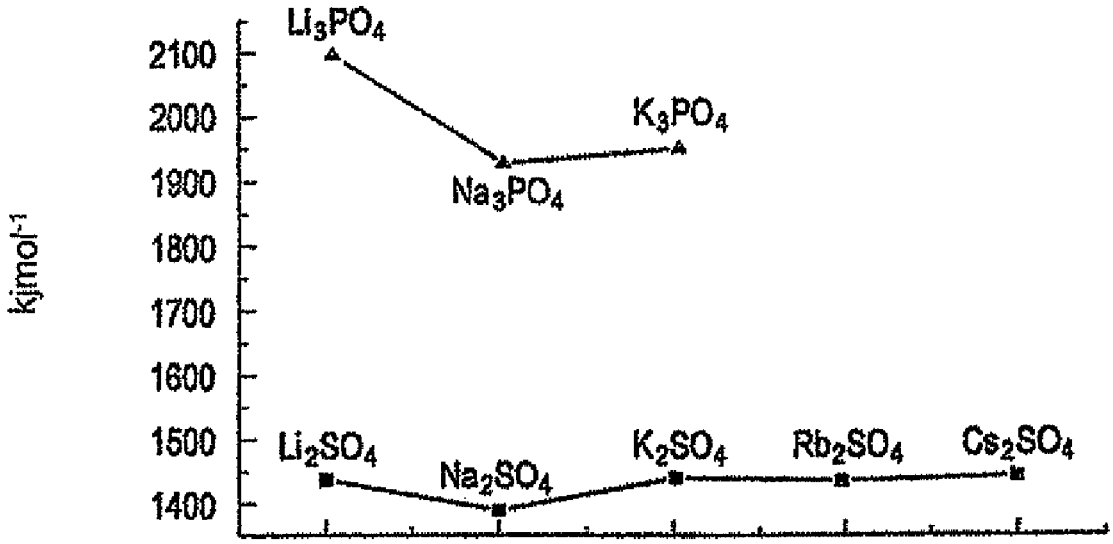
FIG. 2 is a graph showing the comparison of the heat of formation for alkali metal orthophosphates and sulphates.

FIG. 2 shows a comparison of the heat formation for alkaline metal orthophosphates and sulphates. This clearly shows that the use of phosphoric acid, in particular, as an electron acceptor for the first primary aerosol is advantageous in order to achieve as high a radiation power as possible. The ordinate for the heat formation is calibrated in $kjmol^{-1}$.

A further advantage of the infrared area decoys according to the invention is the transmission-attenuating effect of the cloud itself, which still exists after the aerosol cloud has cooled down and is used for extinction of the target signature when the aerosol cloud is deployed directly in front of the target.

A ballistic or powered body which releases its warhead in the target area is used, for example, for deployment of the aerosol cloud which is emissive in the infrared range. This body contains, for example, a first container with the first solution in order to produce the first primary aerosol, and a second container with the second solution in order to produce the second primary aerosol. By way of example, the two containers may each have a nozzle through which the two primary aerosols can be atomized with one another under pressure, or can each be broken down pyrotechnically. This allows as complete thorough mixing as possible, and thus also ensures the reaction of the two primary aerosols.

The body may either only be broken down in the target area or else may have a parachute which is deployed at a specific height. Once the parachute has unfolded, the two primary aerosols are mixed in the manner described above.

The advantages of the invention as described above and as defined in the attached claims are, in particular, the good spectral matching of the infrared area decoy, on, for example, ships, the large required area extent of the infrared area decoys and the lack of visual perceptibility particularly at night and in poor weather, and the avoidance of any fire risk during the deployment of these infrared area decoys.

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What we claim is:

1. A method for the production of an infrared area emitter comprising:

providing a first primary aerosol including an electron acceptor and a second primary aerosol including an electron donor; and reacting the first primary aerosol and the second primary aerosol to provide an aerosol cloud which is emissive in the infrared range.

2. The method of claim 1 wherein the reacting the first and second primary aerosols includes atomization, wherein the first and second primary aerosols are atomized with one another under pressure.

3. The method of claim 1 wherein the providing the first primary aerosol includes selecting a solution of said electron acceptor.

4. The method of claim 1 wherein the electron acceptor is an acid which contains oxygen.

5. The method of claim 4 wherein the electron acceptor is selected from phosphoric acid and sulphuric acid.

6. The method of claim 1 wherein the providing the second primary aerosol includes selecting a solution of said electron donor.

7. The method of claim 6 wherein the electron donor is selected from the group of alkaline metal hydroxides, alkaline metal carbonates, alkaline metal hydrogen carbonates, and mixtures thereof.

8. The method of claim 7 wherein the electron donor contains lithium, sodium, potassium, rubidium or cesium as the alkaline metal.

9. The method of claim 1 wherein the first and the second primary aerosols are reacted in a stoichiometric ratio to ensure maximum heat release.

10. The method of claim 1 wherein the aerosol cloud has emission bands in the wavelength from 3 to 5 microns.

11. The method of claim 1 wherein the aerosol cloud has emission bands in the wavelength from 8 to 14 microns.

12. The method of claim 1 wherein the aerosol cloud does not produce any visual signal.

13. A method for the production of an infrared area emitter comprising:

providing a first primary aerosol including an electron acceptor selected from phosphoric acid and sulphuric acid and a second primary aerosol including an electron donor selected from an alkaline metal hydroxide, an alkaline metal carbonate, an alkaline metal hydrogen carbonate and mixtures thereof; and reacting the first primary aerosol and the second primary aerosol to provide an aerosol cloud which is emissive in the infrared range with emission bands in the wavelength from 3 to 5 and/or 8 to 14 microns, said aerosol clouds does not produce any visual signal.

14. An infrared area emitter comprising an aerosol cloud that is emissive in the infrared range, said aerosol cloud is a reaction product of a first primary aerosol and a second primary aerosol, wherein said first primary aerosol is an electron acceptor and the second primary aerosol is an electron donor.

15. The infrared area emitter of claim 14 wherein the aerosol cloud has emission bands in the wavelength from 3 to 5 microns.

16. The infrared area emitter of claim 14 wherein the aerosol cloud has emission bands in the wavelength from 8 to 14 microns.

17. The infrared area emitter of claim 14 wherein the aerosol cloud does not produce any visual signal.

18. The infrared area emitter of claim 14 wherein the electron acceptor is selected from phosphoric acid and sulphuric acid.

19. The infrared area emitter of claim 14 wherein the electron donor is selected from the group of alkaline metal hydroxides, alkaline metal carbonates, alkaline metal hydrogen carbonates, and mixtures thereof.

* * * * *